United States Patent [19]

Mattarelli

[11] Patent Number: 4,471,551

[45] Date of Patent: Sep. 18, 1984

[54] SAFETY DEVICE FOR FIREARMS

[75] Inventor: Ennio Mattarelli, Neuhausen, Switzerland

[73] Assignee: SIG Schweizerische Industrie-Gesellschaft, Rheinfall, Switzerland

[21] Appl. No.: 438,857

[22] PCT Filed: Feb. 26, 1982

[86] PCT No.: PCT/EP82/00070

§ 371 Date: Oct. 22, 1982

§ 102(e) Date: Oct. 22, 1982

[87] PCT Pub. No.: WO82/02941

PCT Pub. Date: Sep. 2, 1982

[30] Foreign Application Priority Data

Feb. 27, 1981 [IT] Italy ..... 3348 A/81

[51] Int. Cl.[3] ..... F41C 17/02; F41C 17/04

[52] U.S. Cl. ..... 42/70 R; 42/70 E; 42/70 F

[58] Field of Search ..... 42/70 R, 70 E, 70 F; 89/148

[56] References Cited

U.S. PATENT DOCUMENTS 1,376,165 4/1921 Rosebush ..... 42/70 R 2,453,683 11/1948 CAldow ..... 42/70 D

FOREIGN PATENT DOCUMENTS 9345 9/1894 Switzerland .

561016 5/1944 United Kingdom .

*Primary Examiner*—Richard E. Schafer

*Assistant Examiner*—Ted L. Parr

*Attorney, Agent, or Firm*—Burns, Doane, Swecker & Mathis

[57] ABSTRACT

The safety device intended for firearms, particularly rifles, consists of two slides, arranged within the trigger device of the weapon, adjacently to each other, perpendicularly to the longitudinal axis of the bolt and displaceable in guides, with the slides being connected with each other by means of a two arm lever, so that a downward motion of one slide effects an upward movement of the other slide and vice versa, and whereby the lower part of at least one of the slides is projecting into the inner space of the trigger guard. One of the slides is designed so that it locks in the safety position the trigger body associated with the trigger and with its upper end extends through a bore in the bolt wall into a recess of the firing pin. The other slide has a configuration such that it represents in the release position a stop for a stop ring located adjacently to the front end of the bolt.

5 Claims, 5 Drawing Figures

SAFETY DEVICE FOR FIREARMS

The invention concerns a safety device for firearms, especially for rifles, to prevent the accidental discharge of a round.

Safety devices are known in which a press button is acting directly on a trigger element actuating the firing pin, for example a safety catch. These devices have the disadvantage that if the firearm drops to the ground or when the safety catch is broken, a shot may be discharged even though the weapon is secured. Safety devices are further known, in which the firing pin is arrested by means of a press button through a comparatively complex lever gear mechanism. These devices are again unable to provide complete safety.

A further disadvantage of the known safety devices consists of the fact that for safety reasons the safety press button must be located as far as possible from the trigger, with the consequence that to release the weapon, the finger must be taken from the trigger and the release of the safety immediately prior to firing is not possible.

It is the object of the present invention to provide a safety device which offers the highest possible degree of safety by the fact that in the safety position both the trigger and the bolt and the firing pin are locked. Furthermore, the release of the safety device should be possible from the trigger guard. Finally, the device should be capable of preventing the accidental dropping of the bolt from the weapon in the unsecured state, but should not interfere with the intentional removal of the bolt.

The attainment of this object is characterized in the principal claim. The device according to the invention provides a triple safety effect, by that the trigger, the bolt and the firing pin are immobilized. Furthermore, the rifleman will note immediately upon the insertion of his finger into the trigger guard whether the weapon is secured. He is then able to effect its release during the aiming process. Finally, there is no danger in the case of the device according to the invention that the bolt will be pulled out unintentionally in the unsecured state, for example during the repeating of the weapon.

An example of the embodiment of the weapon is shown in the drawing as an example. In the drawing.

Figure 3:
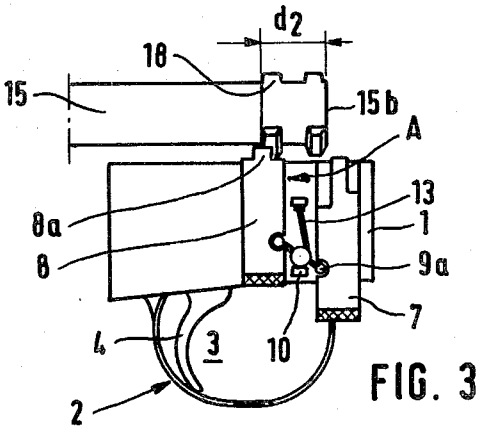
FIGS. 3 and 4 show the safety in the safety and the release state relative to removal of the bolt.

The drawing shows a trigger block 1 in combination with a conventional rifle, of which only part of the bolt 15 and of the firing pin 16 are indicated. Under the trigger block 1 a trigger guard 2 is located; it defines the path of the movement of the trigger 4.

The unit consisting of the trigger 4 and the trigger body 6 is articulated to the trigger block 1 at 5. The trigger 4 may be pivoted within the guard 3, while the trigger body 6 is actively connected with a conventional trigger element of the lock, not shown.

Two slides 7 and 8 are associated with the trigger block; they are arranged adjacently to each other and may be displaced perpendicularly to the longitudinal axis of the bolt 15, while guided in grooves located in the block 1. The two slides 7, 8 are connected with each other by means of a double arm lever 9, so that the lower end at least of the slide 8 extends into the space 3 defined by the guard 2.

The lever 9 has to lever arms **9*a* and 9*b*, the free ends of which are engaging articulation sockets of the slides 7 and 8, and a center piece 9*c* connecting the two lever arms with each other. The center piece 9*c* is cylindrical in configuration, with the longitudinal axis of the cylinder extending perpendicularly to the plane of the drawing, and is bearingly supported in a small bearing block 10 with a cylindrical supporting surface and fastened to the trigger block 1**.

The end of a spring 13 is fastened to the center piece **9*c* of the lever 9 and eccentrically to said lever, with the other end of the spring being connected with the flat surface of a hemisphere 12, the convex surface of said hemisphere being urged by the spring 13, which is being compressed, against the small bearing block 11 also fastened to the block 1. The spring 13 clamped between the center piece 9*c* of the lever and the hemisphere 12 thus retains the two elements 9*c*, 12 in their bearings 10 and 11, and pressures the unit consisting of the slides 7, 8 and the lever 9 in the direction of one of two positions, because the line of action of the spring 13 is eccentric to the center of the dual arm lever 9. Therefore, in order to bring the slides 7, 8 from one position, for example the safety position, into the other position, for example the release position (FIG. 1), a certain force must be applied to one of the slides, which must be sufficient to overcome the counterforce of the spring 13**.

In the safety position C (FIG. 1), the slide 7 is in its uppermost position and the slide 8 in its lowest position; conversely, the release position A is defined (FIG. 2) by that the slide 8 is in its uppermost and the slide 7 in its lowest position.

The slide 7 has at its upper end a finger extension **7*a* with a reduced diameter and a recess 14**.

The safety has in the safety position C three safety functions. One function is to lock the trigger 6 associated with the trigger 4. Secondly, the firing pin 16 is locked and finally the bolt 15 is immobilized against rotation. All three functions are effected by the slide 7. Thus, in the safety position C the end of the extension **6*a* of the trigger body 6 is resting against the lateral surface of the slide 7, whereby the pivoting of the unit consisting of the body 6 and the trigger 4 in the direction of the arrow S around the pivot axis is 5 prevented. The trigger 4 is thereby blocked. Simultaneously, the finger 7*a* reaches through the bolt bore 15*a* into the recess 16*a* of the firing pin 16, whereby both the forward strike of the firing pin 16 and the rotation of the bolt 15** are prevented.

The switch from the position C to the position A, i.e. the activation of the weapon, is effected by the application of pressure in the direction of the arrow $F_1$ to the slide 8, i.e. the slide 8 is being pressured against the force of the spring 13 in the upward direction, until the unit consisting of the pivoting lever and the spring 13 snaps over into the position A. The depression of the slide 8 may be effected by the finger used to actuate the trigger 4, which assures that the period of time between the release of the safety and the discharge of the round may be kept extremely short so that that weapon is actually released immediately prior to firing only.

The slide 8 is dimensioned so that its upper end in the form of a stop **8*a* is touching the bolt 15** in the release position A nearly or slightly only.

In the release position the firing pin 16 and the bolt 15 are free, as the finger 7*a* has exited from the bolt 15. Furthermore, there is nothing to prevent the pivoting of the trigger 4 in the direction of the arrow S (firing of a round), because the end 6*a* of the trigger body 6 is free to enter the recess 14 of the slide 7.

Figure 4:
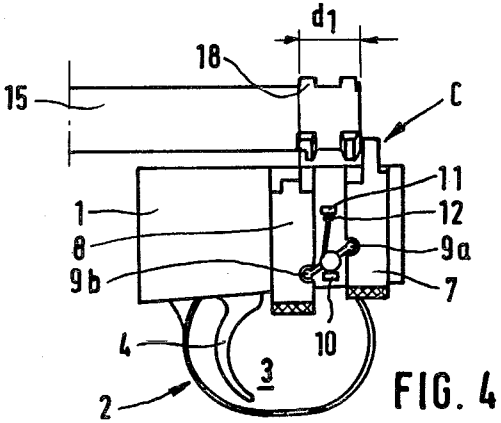
Figure 1:
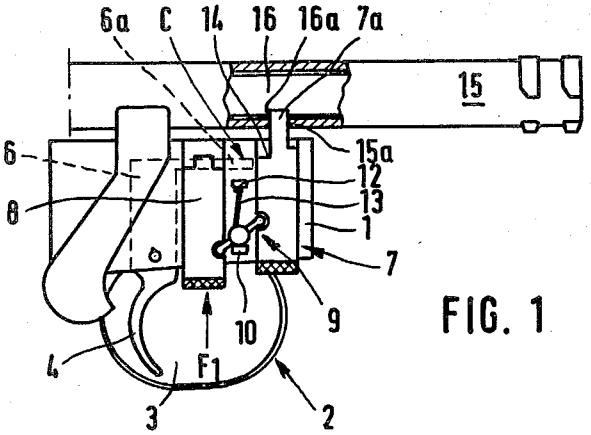
FIGS. 1 and 2 show the safety device in the safety and the release state.
Figure 2:
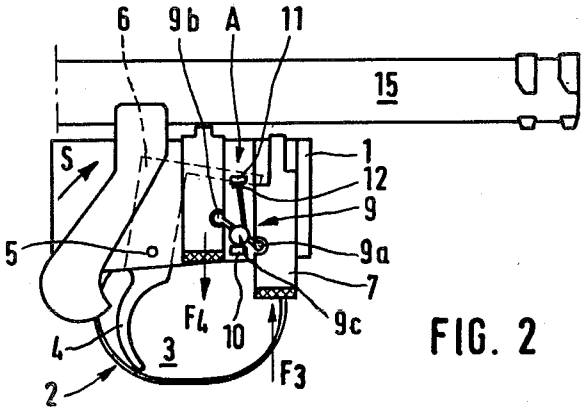
Figure 5:
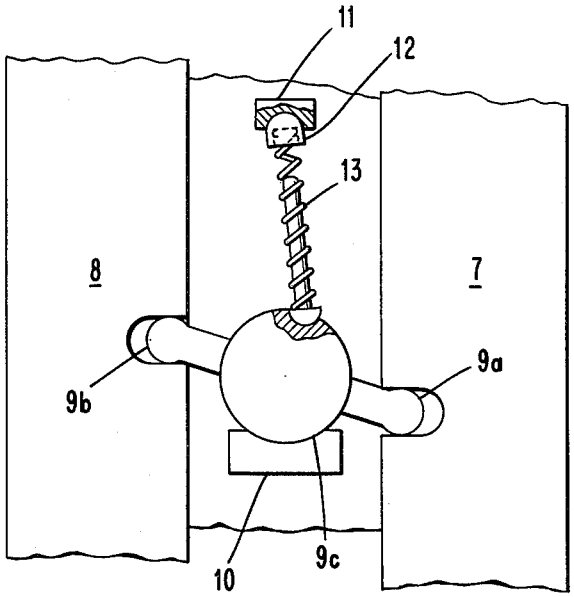
FIG. 5 is an enlarged view of a spring and lever assembly which acts upon two slides when the latter are in their release state corresponding to FIG. 2.

To switch from the A position back into the safety position C, it is merely necessary to apply pressure on the slide 7 in the direction of the arrow $F_3$, with the result that the slide 8 moves in the direction of the arrow $F_4$ downward in the position of FIG. 1. The safety device according to the invention further serves to prevent the dropping out of the bolt 15 during the state of release A, which otherwise may occur during rapid repeating. For this purpose, adjacently to the front end 15*b* of the bolt 15 a stop ring, projecting in the manner of a flange, is provided, which during the withdrawal of the bolt 15 strikes the stop 8*a* of the slide 8 in the uppermost position of said slide (FIG. 3). If the bolt is to be removed intentionally, it is merely necessary to place the safety device in the abovementioned manner into the safety position C, whereupon the stop 8*a* moves in the downward direction and releases the stop ring 18 (FIG. 4). FIG. 3 and 4 show that the removal of the bolt 15 is possible only when the distance $d_1$ between the surfaces of the fingers 8*a* and 7*a* facing each other is larger than the distance $d_2$ between the striking surface of the ring 18 and the end 15*b* of the bolt.

As mentioned hereinabove, the lower end of the slide 8 is protruding in the safety position C into the inner space of the trigger guard 2, with the consequence that the rifleman senses the presence of the slide 8 if he wishes to place his finger on the trigger 4, thereby being made aware of the existence of the safety position C. Release may then be effected either during the aiming process or prior to it.

Further advantages of the process consist of, as mentioned hereinabove, that the locking of the trigger 4 by means of the trigger body 6, the firing pin 16 and the bolt 15, are effected simultaneously. The safety device according to the invention further prevents the dropping out of the bolt the intentional removal of the bolt may be effected rapidly and without difficulty.

Obviously, variants of the example of embodiment shown and described are possible without exceeding the scope of the invention.

I claim:

1. A safety device in a firearm, particularly a rifle, which includes a bolt having an outer wall on which wall there is disposed a flange and in which wall there is disposed a bore, a firing pin disposed in said bolt, said firing pin having a recess therein, a trigger block disposed below said bolt, a trigger guard mounted to said trigger block and defining an inner space, a trigger body mounted to said trigger block for movement between a firing position and a non-firing position, said safety device comprising first and second slidable slides mounted perpendicularly to a longitudinal axis of said bolt, a lever interconnecting said first and second slides for opposing movement such that in a safety position of said slides said first slide is raised and said second slide is lowered, and that in a release position of said slides said first slide is lowered and said second slide is raised, said first slide when in said safety position locks said trigger body in said non-firing position and projects through said bore of said bolt and said firing pin, said second slide when in said safety position projects into said inner space of said trigger guard, and said second slide when in said release position forms a stop for said flange of said bolt.

2. Device according to claim 1, characterized in that the slides are held both in the safety and in the release position by a spring.

3. Device according to claim 2, characterized in that the lever connecting the slides is a double arm lever, the arms of which are connected articulatedly with the slides, that the two arm lever has a center piece of a cylindrical configuration, that in a bearing shell fastened to the trigger block, an axle perpendicular to the longitudinal axis of the lever, is rotatingly supported, that the two arm lever is connected eccentrically with said spring, the other end of which is swingably mounted on the trigger block and that the spring is permanently stressed in a compressed state.

4. Device according to claim 1, characterized in that the first slide is arranged closer to the front end of the weapon than the second slide.

5. Device according to claim 1, characterized in that said flange includes a striking surface which abuts said second slide when the latter is in said release position, the distance between the surfaces facing each other of the upper ends of the slides being equal to or larger than the distance between said striking surface and the front end of the bolt.

* * * * *